US006987937B2

(12) United States Patent
Wazana et al.

(10) Patent No.: US 6,987,937 B2
(45) **Date of Patent: *Jan. 17, 2006**

(54) REASSEMBLED TONER CARTRIDGE AND METHOD OF MANUFACTURE

(75) Inventors: Yoel Wazana, Northridge, CA (US); Joda Paulus, Palmdale, CA (US)

(73) Assignee: Wazana Brothers International, Inc., Chatsworth, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/457,600

(22) Filed: Jun. 9, 2003

(65) Prior Publication Data

US 2004/0047649 A1 Mar. 11, 2004

Related U.S. Application Data

(63) Continuation of application No. 10/238,658, filed on Sep. 9, 2002, now Pat. No. 6,577,830.

(51) Int. Cl.
*G03G 15/00* (2006.01)

(52) U.S. Cl. ..... 399/109

(58) Field of Classification Search ..... 399/109, 399/106, 111; 156/73.5
See application file for complete search history.

(56) References Cited

U.S. PATENT DOCUMENTS

| | | | | |
|---|---|---|---|---|
| 5,585,895 A | | 12/1996 | Yashiro et al. | |
| 5,689,772 A | * | 11/1997 | Fujiwara et al. | 399/106 |
| 5,781,831 A | | 7/1998 | Matsuzaki et al. | |
| 5,870,654 A | * | 2/1999 | Sato et al. | 399/109 |
| 6,029,031 A | * | 2/2000 | Yokomori et al. | 399/109 |
| 6,115,570 A | * | 9/2000 | Kilian et al. | 399/111 |
| 6,240,605 B1 | * | 6/2001 | Stevens et al. | 399/106 |
| 6,289,188 B1 | * | 9/2001 | Litman et al. | 399/109 |
| 6,577,830 B1 | * | 6/2003 | Wazana et al. | 399/109 |
| 6,684,039 B1 | * | 1/2004 | Wazana et al. | 399/109 |

FOREIGN PATENT DOCUMENTS

JP 2002-108175 4/2002

* cited by examiner

*Primary Examiner*—Robert Beatty
(74) *Attorney, Agent, or Firm*—Coudert Brothers LLP; Brian F. Drazich; Jon E. Hokanson

(57) ABSTRACT

A reassembled toner cartridge and method of manufacture in which a reassembled toner cartridge is resealed by simultaneous ultrasonic welding at multiple locations resulting in improved product performance, increased production efficiency and decreased production cost.

6 Claims, 4 Drawing Sheets

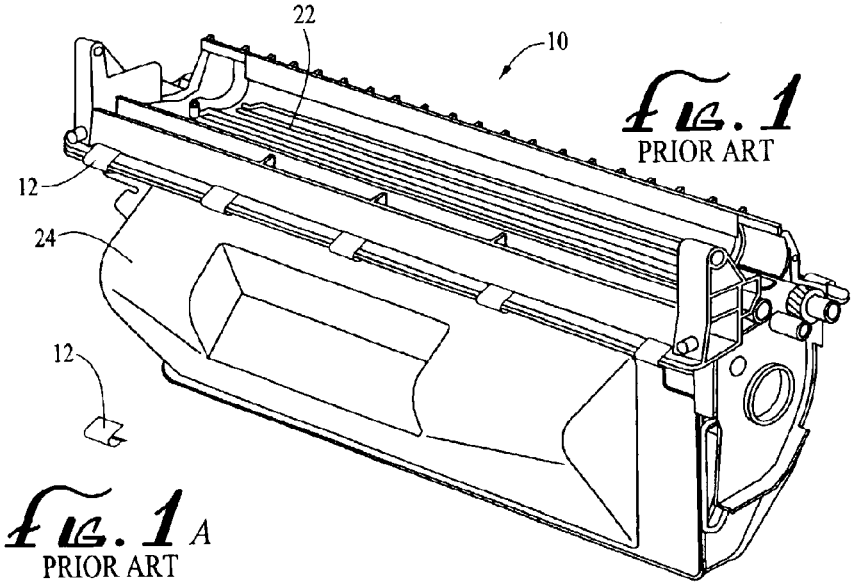
FIG. 1
PRIOR ART
FIG. 1A
PRIOR ART
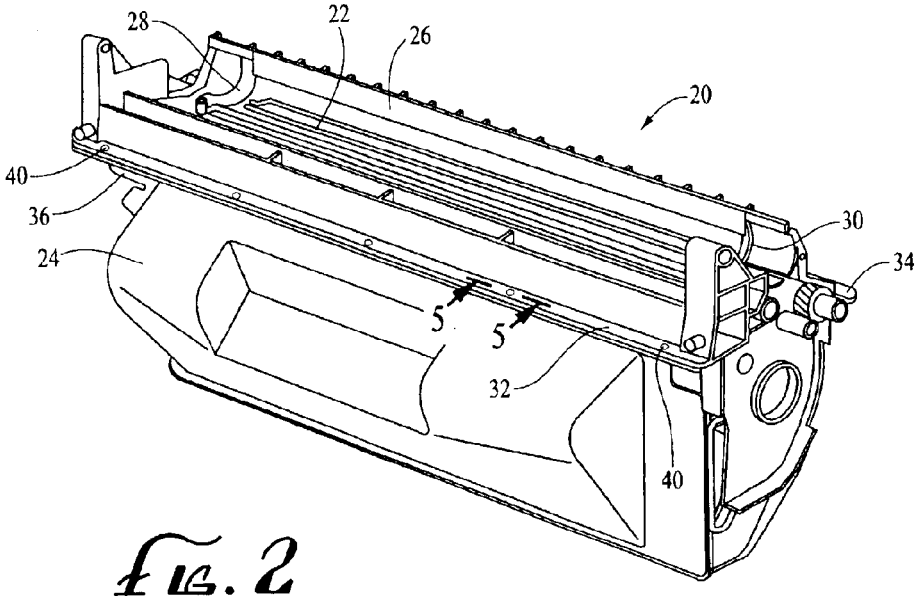
FIG. 2

REASSEMBLED TONER CARTRIDGE AND METHOD OF MANUFACTURE

This is a continuation of application Ser. No. 10/238,658, filed Sep. 9, 2002, now U.S. Pat. No. 6,577,830.

TECHNICAL FIELD

The present invention relates to improvements in the field of laser toner cartridge remanufacture in which a reassembled toner cartridge is resealed by ultrasonic welding resulting in improved product performance, increased production efficiency and decreased production cost.

BACKGROUND ART

Toner or process cartridges for laser printing are engineered and manufactured to a high degree of precision necessary for proper operation and good printed image quality. Central to proper operation of a toner cartridge is the maintenance of alignment and orientation of its various components. Original equipment manufacturers achieve the rigidity necessary to maintain the alignment and orientation of components, in substantial part, by ultrasonically welding the sections of the toner or process cartridge together. The process of remanufacturing a toner or process cartridge requires that the cartridge be disassembled and that the hopper section of the cartridge which holds the toner be separated from the roller section which contains the developer roller and other components. When the hopper and roller sections are separated, however, precise alignment and orientation of performance critical components—including particularly that between the developer roller and sealing blade and/or between the developer roller and developing blade may be lost.

Heretofore, a problem has existed in aligning the sealing blade and/or the developing blade with the developer roller with the necessary precision during reassembly of the hopper and roller sections. The conventional approach to this problem has been to manually carefully align and fit the two sections together, with or without the aid of a positioning jig, then to manually secure the sections together with a number of metal clips. Alternatively, the sections maybe fastened together with adhesive or glue. This technique, while generally effective suffers a number of drawbacks.

A primary drawback is that both metal clips and adhesive are consumables which increase production costs and cost of the final product. Another significant drawback is that manual reassembly is quite labor intensive and is subject to human error and variation in quality. In the case of reassembly with adhesive or glue, there typically is a period of a few to several minutes for bonding to take place during which alignment must be maintained, and which increases production time and cost. Further, resealing with adhesive often fuses or bonds the sections together, rendering subsequent separation for additional remanufacturing cycles difficult or impossible.

An additional drawback in the use of metal clips to reassemble the cartridge is that the rigidity imparted by the original ultrasonic weld is difficult to achieve, and over the working life of the cartridge the clips may loosen or become disengaged entirely. In such event, as a result of loss of proper alignment of the sealing blade and/or developing blade with the developer roller, excessive toner may accumulate on the developer roller with the result that a mass of excess toner will be transferred to the photoconductive printing drum and thence to the printer paper thereby degrading the printed image quality. Further, disengagement of a metal clip may permit toner to leak from the cartridge. In many printing devices (such as printers, facsimile machines or copiers), the path of the paper through the printing device passes nearby to an edge of the toner cartridge where the metal clips have been installed. Hence, papers jams may occur if a loose metal clip projects into the paper path.

Although toner cartridges manufactured from new components by original equipment manufactures typically are sealed by ultrasonic welding, that technique has until now been unavailable for use in the remanufacture or reassembly of toner cartridges. A primary impediment to the use of ultrasonic welding in the rejoining of the hopper section and roller section of a toner cartridge during reassembly has been the absence of an energy director element. Briefly, an energy director element is a relatively small feature—typically in the form of a ridge or bump—which extends slightly above the surface of the surrounding area and contacts the surface to be welded. The energy director is of the same material as the remainder of the plastic component and is formed in the mold in which the plastic component is created. During the ultrasonic welding process it is the energy director element which is first melted primarily as a result of the friction created between the two surfaces to be welded caused by the ultrasonic vibrations. It is the melting together of the surfaces to be bonded at the location of the energy director element which, upon cooling and solidification, welds the two surfaces together. Thus, the energy director element is largely or entirely consumed or destroyed in the sealing together of the hopper section and roller section in the original manufacture of a new toner cartridge. Hence, upon separation of the hopper and roller sections at the location of the original ultrasonic weld during the remanufacturing process, there no longer exists an energy director element from which to initiate ultrasonic welding to rejoin or reseal the these components.

The present invention is directed to solving these problems by providing a reassembled toner cartridge and method of manufacture in which the hopper section and roller section are ultrasonically welded together without the necessity of an energy director element, and without the need for or use of consumable components.

DISCLOSURE OF INVENTION

In its several embodiments, the present invention improves the appearance and operational performance of toner cartridges which have been recycled or remanufactured from components including those from previously depleted toner cartridges, and provides a method whereby this may be accomplished.

It is a primary object of the present invention to provide an improved method of rejoining subassemblies of previously depleted toner cartridges without the use of mechanical fasteners, such as screws, clips, rivets or the like.

It is another object of the present invention to provide an improved method of rejoining subassemblies of previously depleted toner cartridges without the use of adhesive.

A further object of the present invention is to provide an improved method of rejoining subassemblies of previously depleted toner cartridges which permits the toner cartridge to be separated again at the location of the rejoining.

It is yet another object of the present invention to provide an improved method of rejoining subassemblies of toner cartridges that reduces human error in the rejoining process.

It is yet another object of the present invention to provide an improved method of rejoining subassemblies of recycled or remanufactured toner cartridges that employs ultrasonic welding.

It is yet another object of the present invention to provide an improved method of rejoining subassemblies of toner cartridges that employs ultrasonic welding without the use of a specially fabricated energy director element.

It is yet another object of the present invention to provide an improved method of rejoining subassemblies of toner cartridges that achieves and maintains, over the entire working life of a recycled or remanufactured toner cartridge, the proper alignment and position of the sealing blade and developing blade relative to the developer roller.

It is yet another object of the present invention to provide an improved method of rejoining subassemblies of recycled or remanufactured toner cartridges that is uniformly reproducible and reliable.

It is yet another object of the present invention to provide an improved method of rejoining subassemblies of recycled or remanufactured toner cartridges that is faster than conventional manual methods.

It is a further object of the present invention to provide a recycled or remanufactured toner cartridge that is resealed by ultrasonic welding.

It is a further object of the present invention to provide a recycled or remanufactured toner cartridge that is resealed by ultrasonic welding without the use of a specially fabricated energy director element.

BRIEF DESCRIPTION OF THE DRAWINGS

Other objects and advantages of the invention will become apparent from the forgoing detailed description taken in connection with the accompanying drawings, in which:

FIG. 1 is a perspective view of a prior art toner cartridge in which the hopper section and the roller section are fastened together by clips.

FIG. 1A is a perspective view of a prior art fastening clip.

FIG. 2 is a perspective view of a toner cartridge of the present invention in which the hopper section and the roller section are fastened together by ultrasonic welding.

BEST MODE FOR CARRYING OUT THE INVENTION

Figure 3:
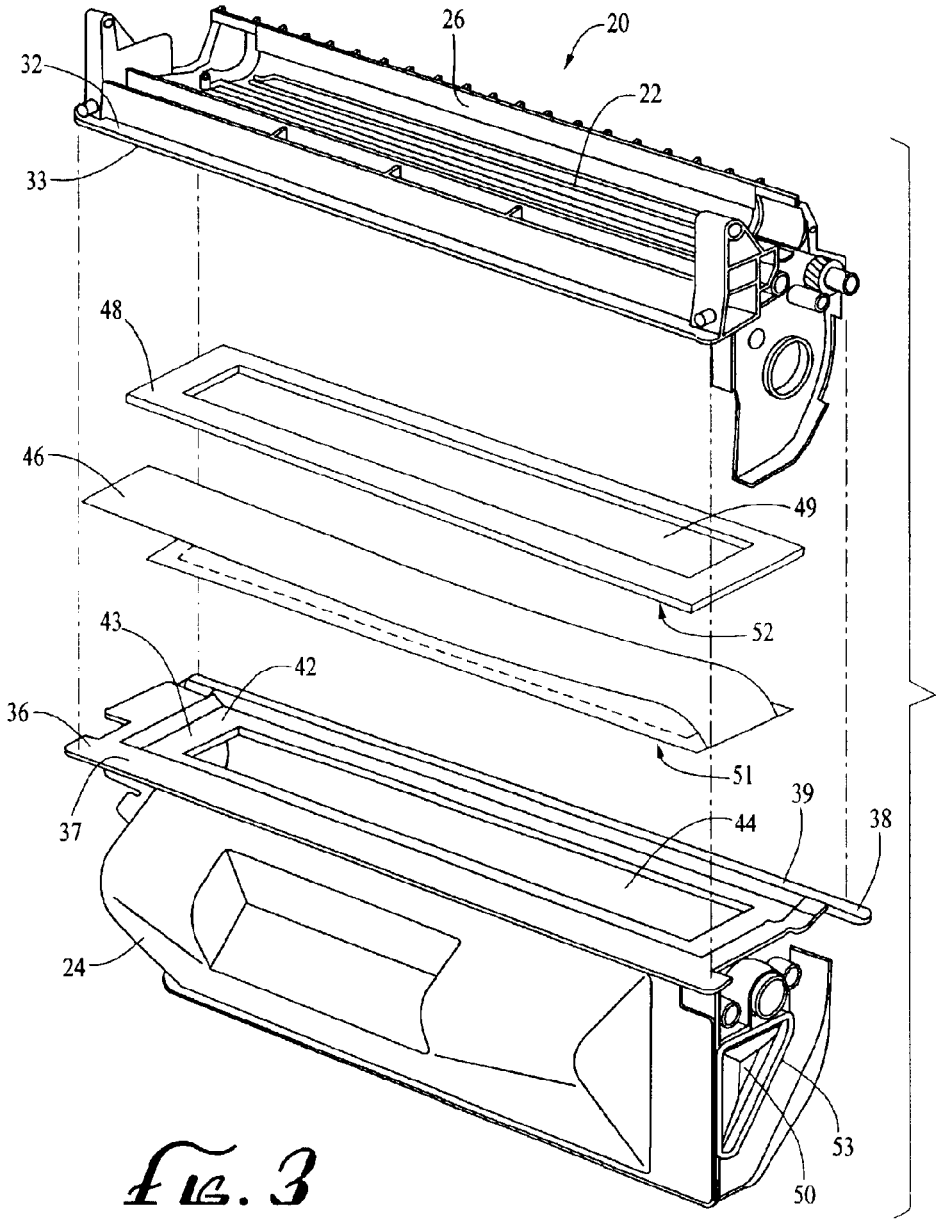
FIG. 3 is partially disassembled perspective view of the hopper section, hopper section toner port perimeter seal, toner port ribbon seal and roller section assemblies of a toner cartridge of the present invention.

To illustrate and further describe the embodiments of the present invention, reference will be made to FIGS. 1–6.

FIG. 1 is a perspective view of a prior art plastic toner cartridge (10) in which the hopper section (24) and the roller section (22) are fastened together by clips (12), a perspective view one of which is separately shown in FIG. 1A. With reference to FIG. 2 the remanufactured toner cartridge of the present invention (20) includes first peripheral lip (32) and second peripheral lip (34) of plastic roller section (22), and first peripheral lip (36) and second peripheral lip (38)(not shown) of plastic hopper section (24). Sealing blade (26) is disposed adjacent the developer roller (80) which is rotatably attached to roller supports (28) and (30) in roller section (22). Sealing blade (26) is conventionally fabricated of mylar sheet material having a thickness generally of the order of about 0.004". It is highly preferred that the sealing blade (26) be essentially straight and uniformly positioned with respect to the surface of the developer roller (80) along its length. Variations in the degree of straightness or uniformity of positioning of sealing blade (26) with respect to the surface of the developer roller (80) lead to accumulation of excess toner on the developer roller (80) with the printed image degrading results described above. Slight conformational changes of the deformable plastic roller section (22) can have a significant effect on the degree of straightness or uniformity of positioning of sealing blade (26) with respect to the surface of the developer roller (80). Accordingly, precise control of the conformation of the roller section (22) and hopper section (24) during toner cartridge reassembly is highly preferred and is achieved as described below.

FIG. 3 is a partially disassembled perspective view of the hopper section (24), hopper section toner port perimeter seal (48), toner port ribbon seal (46) and roller section (22) assemblies of a toner cartridge (20) of the present invention. The toner cartridge (20) includes other components such as a waste hopper, developer roller, and other subassemblies which are not shown in FIGS. 2–4 for clarity. Hopper section (24) includes toner port seal cavity (42) in which is formed toner port (44). Sealing surface (43) of cavity (42) is adapted to accept and mates with adhesive surface (51) of toner port ribbon seal (46) and adhesive surface (52) of toner port perimeter seal (48), to close and seal toner port (44). Toner port ribbon seal (46) and toner port perimeter seal (48) are commercially available as an integral unit from C.F. Technology (Goldseal). Perimeter seal (48) covers a larger area than does ribbon seal (46) and thus maintains a seal against toner leakage upon removal of the ribbon seal by the end user. Also, hopper section (24) includes toner fill port (53) closed by hopper cap (50).

With further reference to FIG. 3, hopper section (24) includes first peripheral lip (36) having mating surface (37) and second peripheral lip (38) having mating surface (39). Roller section (22) includes first peripheral lip (32) having mating surface (33) and second peripheral lip (34) having mating surface (35)(not shown). In reassembly of the hopper section (24) together with the roller section (22) mating surfaces (33) and (35) (not shown) are juxtaposed and interface with mating surfaces (37) and (39), respectively, as is shown in FIG. 2. The proper alignment and conformation of cartridge sections (22) and (24) during reassembly to assure of the preferred degree of straightness and uniformity of positioning of sealing blade (26) with respect to the surface of the developer roller (80) is provided by cartridge clamping jig (60) as is depicted schematically in FIG. 4. Clamping jig (60) is adapted to impose the preferred alignment and configuration on the cartridge assembly (20) during ultrasonic welding and bond curing.

Figures 4, 5:
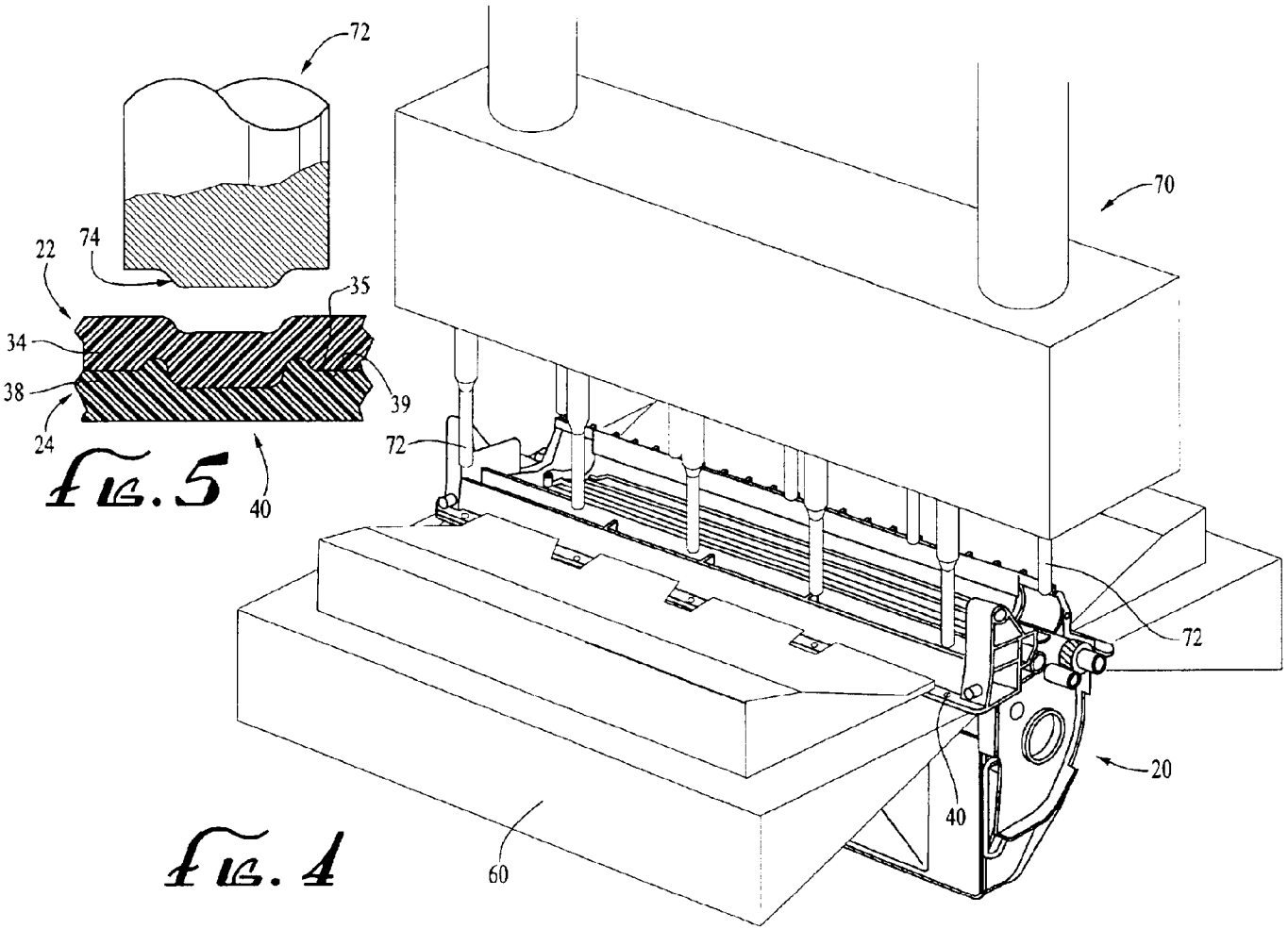
FIG. 4 is a perspective view of an apparatus used in the ultrasonic welding step of the present invention.
FIG. 5 is a cross-sectional view through a portion of the FIG. 2 assembly of a cartridge of the present invention at the location of an ultrasonic weld stylized to represent conformational change due to melting and pressure from the welding tip which is depicted in partial cross-section with a stylized tip face.

Now, with reference to FIG. 4, ultrasonic welding of sections (22) and (24) together is accomplished by a multihead ultrasonic welding apparatus (70) such as is available from Branson Ultrasonics Corporation, Danbury, Conn. It is preferred that welding at multiple locations take place simultaneously. However, it will be understood by one of ordinary skill in the art that welding at multiple locations may take place sequentially.

The preferred locations for the ultrasonic welding of sections (22) and (24) is along peripheral lips (32), (34), (36)

and (38) as is depicted schematically in FIGS. 2 and 4. It has been determined that five ultrasonic spot welds along each side of the remanufactured toner cartridge (20) is preferred to achieve the preferred alignment and configuration of the cartridge assembly, and to provide integrity against toner leakage. It will be understood by one skilled in the art that fewer or more than a total of five ultrasonic weld locations along each side of the toner cartridge (20) may be selected. It has further been determined that placement of the five ultrasonic welds (40) approximately uniformly along the toner cartridge lips as is depicted schematically in FIGS. 2 and 4 is preferred.

With reference to FIG. 5, an ultrasonic weld (40) is schematically depicted in cross-section to represent conformational change due to melting of the two cartridge sections (22) and (24) and pressure from titanium ultrasonic welding tip (72) which is depicted in partial cross-section with stylized tip face (74). The localized melting together of the two interfaced plastic surfaces in proximity to the energized titanium welding tip followed by maintenance of pressure during solidification of the melted material results in formation of an adhesive bond or weld.

Figure 6:
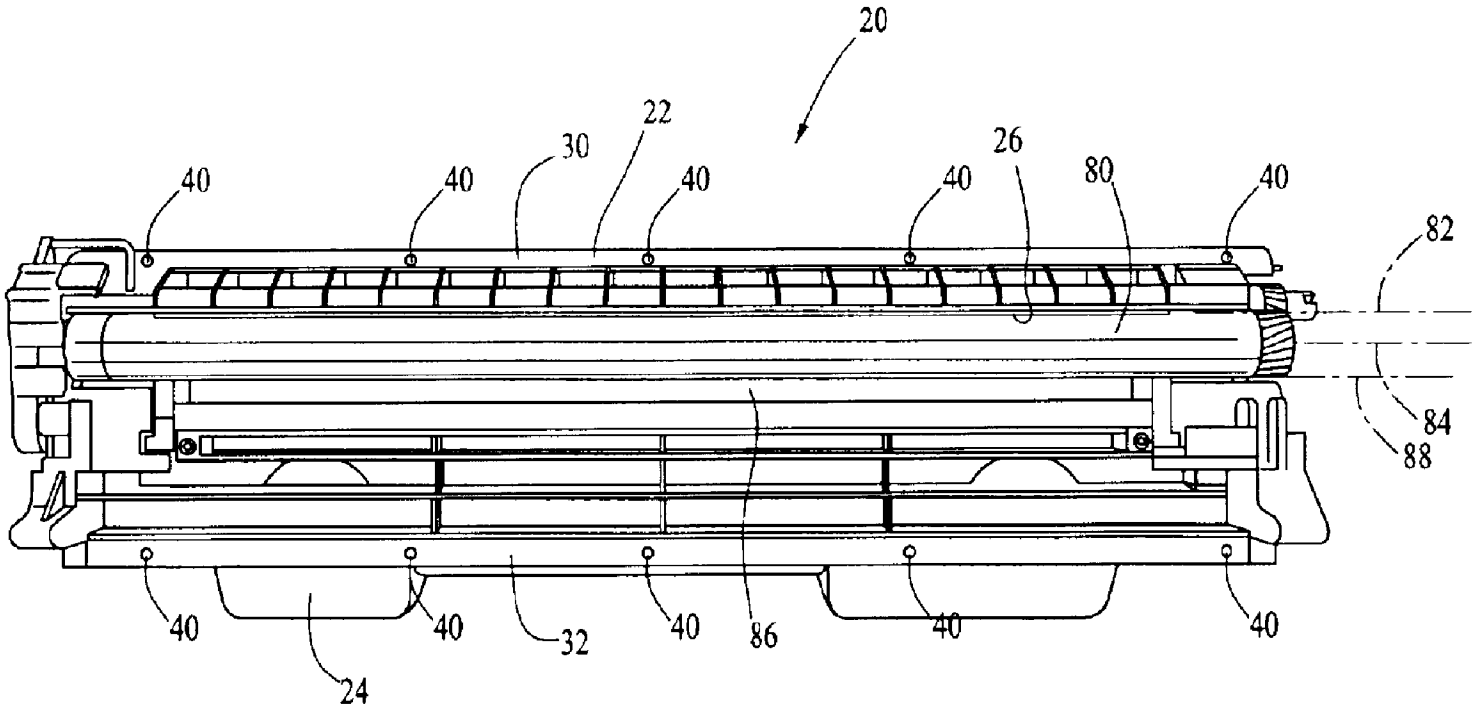
FIG. 6 is a top perspective view of a toner cartridge of the present invention with a developer roller installed.

With reference to FIG. 6, the developer roller (80) is disposed and rotatingly mounted in the roller section (22). Developer roller (80), which is essentially a right circular cylinder in geometry having a longitudinal axis (84), is disposed such that its longitudinal axis (84) extends along the length, or the greatest dimension, of roller section (22). Sealing blade (26) is disposed in roller section (22) such that the greatest dimension, or length, of sealing blade (26) also extends along the length, or the greatest dimension, of roller section (22), as has been previously described. The edge of sealing blade (26) proximate roller (80) defines sealing blade axis (82). Similarly, developing blade (86) is also disposed in roller section (22) such that the greatest dimension of developing blade (86) extends along the length, or the greatest dimension, of roller section (22). The edge of developing blade (86) proximate roller (80) defines developing blade axis (88).

With further reference to FIG. 6, reassembled toner cartridge (20) is maintained in preferred alignment and configuration by ultrasonic welds (40) such that longitudinal axis (84) of developer roller (80) and sealing blade axis (82) are essentially parallel along the extent or length of sealing blade (26), and the proximate surfaces of sealing blade (26) and roller (80) are maintained in substantially constant relation to each other over their mutual extent.

Finally, with yet additional reference to FIG. 6, reassembled toner cartridge (20) is maintained in preferred alignment and configuration by ultrasonic welds (40) such that longitudinal axis (84) of developer roller (80) and developing blade axis (88) are essentially parallel along the extent or length of developing blade (86), and the proximate surfaces of developing blade (86) and roller (80) are maintained in substantially constant relation to each other over their mutual extent.

The Reassembly Process

The steps and procedures of the method of remanufacture of the reassembled toner cartridge of the present invention are described below.

The depleted toner cartridge (20) is visually inspected for damage and whether it is suitable to be remanufactured. It is then partially disassembled to remove external components including the waste hopper, gear housing end plates, rollers, and hopper cap, etc. Next, any residual toner is removed and the cartridge is cleaned.

The roller section (22) is then separated from the hopper section (24) along the plane of the ultrasonic weld joining the two sections by a rotating blade which cleaves the ultrasonic weld. Thereafter the components are inspected for cleanliness and integrity, and reused, discarded or recleaned as appropriate. The toner port seal (46) and (48) (C.F. Technology Goldseal) is next installed in hopper section, the hopper section is refilled with appropriate toner, and the hopper cap (50) is installed after which the hopper section is tested for toner leaks.

The roller section (22) is then mated with the recharged hopper section (24) and the loose assembly is placed into a clamp jig which has been constructed to properly align and configure the particular type or model of cartridge being processed. The clamp jig is operated to impose the preferred alignment and configuration on the cartridge assembly. While the cartridge is clamped in the jig, a multi-head (ten heads being preferred) ultrasonic welding apparatus simultaneously welds the roller section (22) and the hopper section (24) together at ten predetermined locations. This welding process requires approximately 1 second. Pressure on the weld points is maintained by the welding apparatus for approximately 10 seconds until the bond has cured, after which the resealed cartridge (20) is removed from the jig.

Following resealing of the recharged toner cartridge, components—new or reconditioned as necessary (developer roller, photoconductive drum, developer blades, etc.)—are installed in the roller section. Finally, the waste hopper is installed and the finished reassembled toner cartridge is subjected to post production quality control testing, after which it is packaged for shipment.

While the present invention has been described in connection with what are present considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A method of making a reassembled toner cartridge comprising:

disassembling a depleted toner cartridge having a hopper section containing a toner port and having a first mating surface interfacing with a second mating surface of a roller section along the plane of which interfacing said mating surfaces the hopper section and the roller section are ultrasonically welded together;

separating said roller section from said hopper section along the plane of the ultrasonic weld;

installing a toner port seal in said hopper section;

filling the hopper section with toner;

aligning the hopper section and the roller section with said first mating surface of the hopper section interfacing with said second mating surface of the roller section;

ultrasonically re-welding the hopper section and the roller section together along the plane of their interfacing mating surfaces.

2. The method of making a reassembled toner cartridge of claim 1 wherein:

said ultrasonic re-welding does not require a specially fabricated energy director element.

3. A reassembled toner cartridge comprising:

a hopper section having a previously ultrasonically welded mating surface;

a roller section having a mating surface interfacing with said previously ultrasonically welded mating surface of the hopper section; and the mating surface of the roller section ultrasonically welded to said previously ultrasonically welded mating surface of the hopper section.

4. A reassembled toner cartridge comprising:

a roller section having a previously ultrasonically welded mating surface;

a hopper section having a mating surface interfacing with said previously ultrasonically welded mating surface of the roller section; and the mating surface of the hopper section ultrasonically welded to said previously ultrasonically welded mating surface of the roller section.

5. A method of making a reassembled toner cartridge comprising:

disassembling a depleted toner cartridge having a hopper section containing a toner port and having a first mating surface interfacing with a second mating surface of a roller section along the plane of which interfacing said mating surfaces the hopper section and the roller section are ultrasonically welded together;

separating said roller section from said hopper section along the plane of the ultrasonic weld;

refilling the hopper section with toner;

aligning the hopper section and the roller section with said first mating surface of the hopper section in interfacing contact with said second mating surface of the roller section;

melting a first area of said first mating surface and melting a juxtaposed second area of said second mating surface by application of ultrasonic energy to at least one of said hopper section and said roller section;

allowing the melted said first area and the melted said second area to mix;

cooling the melted said first area and the melted said second area to form at least one severable bond along the plane of said interfacing mating surfaces.

6. The reassembled toner cartridge produced by the method of claim 2, claim 3, or claim 5.

* * * * *